US008915711B2

(12) United States Patent
Billotey et al.

(10) Patent No.: US 8,915,711 B2
(45) Date of Patent: Dec. 23, 2014

(54) EROSION INDICATOR FOR A COMPRESSOR WHEEL

(75) Inventors: Geoffroy Billotey, Pau (FR); Olivier Descubes, Pau (FR); Sylvain Gourdant, Gelos (FR); Olivier Tuot, Pau (FR)

(73) Assignee: Turbomeca, Bordes (FR)

( * ) Notice: Subject to any disclaimer, the term of this patent is extended or adjusted under 35 U.S.C. 154(b) by 645 days.

(21) Appl. No.: 13/201,542

(22) PCT Filed: Feb. 9, 2010

(86) PCT No.: PCT/FR2010/050205

§ 371 (c)(1),
(2), (4) Date: Aug. 15, 2011

(87) PCT Pub. No.: WO2010/094873

PCT Pub. Date: Aug. 26, 2010

(65) Prior Publication Data

US 2011/0299987 A1 Dec. 8, 2011

(30) Foreign Application Priority Data

Feb. 19, 2009 (FR) ..... 09 51085

(51) Int. Cl.
*F04D 29/28* (2006.01)

(52) U.S. Cl.
CPC ..... *F04D 29/289* (2013.01)
USPC ..... 416/61; 416/185; 416/183

(58) Field of Classification Search
CPC ..... F01D 5/048; F04D 29/2216
USPC ..... 416/61, 183, 185
See application file for complete search history.

(56) References Cited

U.S. PATENT DOCUMENTS

| | | | | |
|---|---|---|---|---|
| 4,183,719 | A * | 1/1980 | Bozung | 416/183 |
| 4,195,473 | A * | 4/1980 | Aspinwall | 60/794 |
| 5,052,803 | A * | 10/1991 | Krauter | 356/241.4 |
| 5,735,669 | A * | 4/1998 | Niemela | 416/60 |
| 6,976,828 | B2 * | 12/2005 | Godichon et al. | 416/183 |
| 2001/0007632 | A1 | 7/2001 | Pesek et al. | |
| 2006/0159547 | A1 | 7/2006 | Gordon et al. | |
| 2011/0064583 | A1 | 3/2011 | Billotey et al. | |

FOREIGN PATENT DOCUMENTS

| | | |
|---|---|---|
| EP | 1 985 801 | 10/2008 |
| GB | 2 449 709 | 12/2008 |
| JP | 2004 044423 | 2/2004 |
| RU | 2 345 268 C1 | 1/2009 |
| SU | 1249150 A1 | 8/1986 |

OTHER PUBLICATIONS

International Search Report issued Apr. 20, 2010 in PCT/FR10/050205 filed Feb. 9, 2010.
U.S. Appl. No. 13/256,371, filed Sep. 13, 2011, Billotey et al.
English translation of the Decision on Grant issued Jan. 16, 2014 in Russian Patent Application No. 2011138200/06.

* cited by examiner

*Primary Examiner* — Ninh H Nguyen
(74) *Attorney, Agent, or Firm* — Oblon, Spivak, McClelland, Maier & Neustadt, L.L.P.

(57) ABSTRACT

A centrifugal compressor wheel including a hub, a web extending radially from the hub, and a plurality of blades carried by the wheel. The web includes an erosion indicator of the wheel.

9 Claims, 2 Drawing Sheets

EROSION INDICATOR FOR A COMPRESSOR WHEEL

FIELD OF THE INVENTION

The present invention relates to the field of turbomachine compression stages, such as, for example, but not exclusively, aircraft turbine engines and in particular the invention relates to the problem of wear of the elements constituting such compression stages.

BACKGROUND OF THE INVENTION

More precisely, the present invention relates to one of the component elements thereof, i.e. a centrifugal compressor wheel that comprises a hub, a web extending radially from the hub, and a plurality of blades carried thereby.

Below, the adjectives "axial" and "radial" are considered relative to the axis of rotation of the compressor wheel.

Such a centrifugal compressor wheel, well known from elsewhere, co-operates with a radial diffuser to compress the air that enters the compression stage axially prior to leaving it radially.

In known manner, each of the blades extends from a leading edge to a trailing edge and it presents a pressure side and a suction side.

While the compression stage is in operation, particularly but not exclusively when fitted to an aircraft turbine engine, such as a helicopter gas turbine, the compressor wheel tends to become eroded, in particular because particles such as sand become ingested into the compression stage.

After several hours of operation, it is generally found that erosion profiles are present, in particular in the form of retreats of the leading edges and of furrows at the roots of the blades on the pressure sides and extending towards the trailing edges. In other words, the presence of furrows in those locations of the wheel is the result of the wheel being eroded.

The retreat of the leading edges may give rise to degraded performance and degraded aerodynamic stability of the compressor, and also to degradation in the mechanical strength of the blades. Furthermore, the furrow degrades the mechanical strength of the impeller disk. Erosion of the leading edges is easily detected by conventional means (a camera looking into the air inlet of the engine) and it can happen that it is not as great as the furrow type erosion. It is therefore necessary also to inspect for furrow type erosion, such that once the compressor wheel is excessively eroded by the furrow, it is necessary to change the wheel.

Generally, the erosion profile is very fine and not very visible, so it is difficult to determine quickly whether the amount of erosion that has appeared is or is not acceptable.

OBJECTS AND SUMMARY OF THE INVENTION

An object of the present invention is to provide a centrifugal compressor wheel in which furrow type erosion can be inspected quickly and simply.

The invention achieves its object by the fact that the web includes an erosion indicator of the wheel.

The erosion indicator is selected so that when it is completely eroded, the level of erosion of the compressor wheel is such that it needs to be replaced.

It can also be understood that the erosion indicator is clearly visible so that a mechanic can easily and quickly inspect the wear state of the compressor wheel.

According to the invention, the erosion indicator erodes progressively as the furrow forms in the web of the compressor wheel. The indicator is preferably arranged in such a manner that the erosion gives rise to a decrease in the axial thickness of the web, and thus of the erosion indicator.

Preferably, the erosion indicator is situated on an outer peripheral edge of the web, such that it is easy to inspect formation of the furrow and, once more, the erosion indicator when positioned in this way does not disturb the flow of air through the compressor wheel.

In a particularly advantageous embodiment, the wear indicator comprises at least one rib projecting radially from a peripheral edge of the web, the rib presenting an axial thickness that is less than the axial thickness of the web so as to form a step between a flat of the rib and a surface of the web from which the blades extend.

In other words, the rib presents a radial extent that is slightly greater than that of the associated blade, given that the term "radial extent" is used to mean the radial distance measured from the axis of rotation of the compressor wheel.

In other words, the rib constitutes a radial extra thickness on the peripheral edge of the web.

During erosion of the wheel, the furrow that forms at the root of the blade tends to consume the thickness of the blade in an axial direction, in particular at the trailing edge. As a result, the step is eroded progressively in its axial extent direction, it being specified that the term "axial extent" is used to mean the distance between the flat of the rib and the inside surface of the web carrying the blade. This axial extent also corresponds to the difference between the axial thickness of the web measured at its peripheral edge and the axial thickness of the rib.

Thereafter, when the entire step has been eroded as a result of the furrow being formed, the furrow begins to be formed in the flat of the rib.

The inventors have found that the beginning of rib erosion is particularly visible in the flat of the rib, such that, advantageously, it is easy to identify the end of erosion of the erosion indicator.

Thus, in particularly convenient manner, a mechanic will know that it is necessary to replace the compressor wheel as soon as a trace of erosion can be seen on the rib.

For this purpose, the axial extent of the step is advantageously calibrated.

Preferably, the step presents an axial extent lying in the range 0.5 millimeters (mm) to 1.5 mm.

Also, the radial extent of the rib preferably lies in the range 0.5 mm to 3 mm.

According to the invention, the wear indicator is constituted by one or more ribs. Nevertheless, it is preferable to select a single rib that extends all along the circumference of the peripheral edge of the web.

It should be added that in the past inspecting a compressor wheel for erosion has required the compressor wheel to be completely removed. Such removal is generally performed during an overhaul or a repair of the turbomachine and is usually lengthy and expensive, and also causes the aircraft to be grounded.

The present invention also provides a turbomachine compression stage including a compressor wheel of the invention, together with a casing provided with an inlet to enable an endoscope to be inserted into the compression stage so as to inspect the wear of the erosion indicator.

Thus, by means of the invention, it is no longer necessary to remove the compressor wheel in order to inspect its erosion, insofar as a mechanic can inspect wear of the wheel by aiming a camera at the wear indicator. Then by causing the compressor wheel to turn, the mechanic can easily inspect the erosion produced by the furrows formed at the roots of each of the blades of the wheel.

The camera is preferably an endoscope.

The present invention also provides a turbomachine including a compression stage of the invention. The turbomachine is preferably a turbine engine for a helicopter or any other aircraft.

Finally, the present invention provides a method of determining the erosion of a centrifugal compressor wheel of a turbomachine of the invention, in which method an endoscope is inserted into the compression stage in order to inspect the wear of the erosion indicator of said wheel.

In the method, the endoscope is inserted through an opening provided in the casing, preferably at a bulge, and it then penetrates through the diffuser until it is possible to observe the peripheral edge of the web and thus the erosion indicator.

Thus, by means of the method, the extent of erosion can be tracked directly in service and not only during overall maintenance of the turbomachine.

BRIEF DESCRIPTION OF THE DRAWINGS

The invention can be better understood and its advantages appear better on reading the following description of an embodiment given by way of non-limiting example. The description refers to the accompanying drawings, in which.

MORE DETAILED DESCRIPTION

Figure 1:
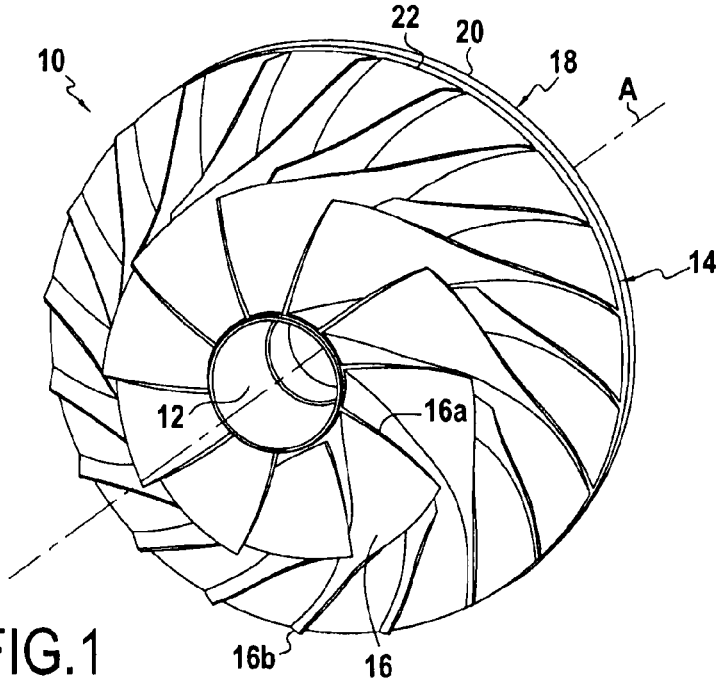
FIG. 1 is a perspective view of a compressor wheel of the invention showing a wear indicator constituted by a rib extending along the circumference of the peripheral edge of the web.

FIG. 1 is a perspective view of a compressor wheel 10 of the kind usually to be found in helicopter gas turbines. Naturally, the present invention also applies to other types of turbine engine that include a compressor wheel.

In known manner, the compressor wheel 10 comprises a hub 12 for co-operating with a drive shaft (not shown) in order to drive the wheel 10 in rotation about its axis A. In the description below, the adjectives "radial" and "axial" are used relative to the axis A. The compressor wheel 10 is for mounting in a casing to face a diffuser 11 of a compression stage 13 that can be seen in FIG. 7.

Figure 2:
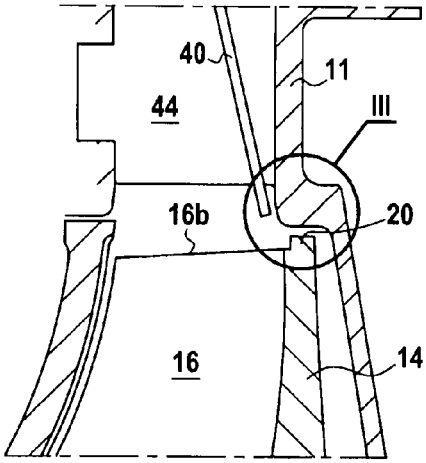
FIG. 2 is a fragmentary section view of a compression stage showing a downstream end of the FIG. 1 wheel.

The compressor wheel 10 also includes a web 14 that can be seen more clearly in FIG. 2, which web extends radially from the hub 12.

Figure 3:
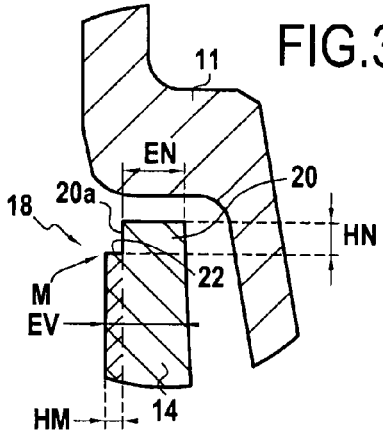
FIG. 3 is a detailed fragmentary view of FIG. 2 showing the erosion indicator of the FIG. 1 wheel together with a portion of the diffuser casing of the compression stage.

Furthermore, the compressor wheel 10 carries a plurality of blades 16, each extending between a leading edge 16*a* and a trailing edge 16*b*. It is also known that these blades 16 are carried by the hub 12 and the web 14. As can be seen in FIGS. 2 and 3, in this example, the trailing edges 16*b* of the blades 16 are flush with a peripheral edge 22 of the web 14.

In accordance with the present invention, the web 14 of the compressor wheel 10 includes an erosion indicator 18 that, in this example, comprises a rib 20 (preferably but not necessarily a single rib), said rib 20 projecting radially from the peripheral edge 22 of the web 14 at the location of the trailing edge 16*b* of each of the blades 16.

With reference to FIGS. 2 and 3, there follows a description in greater detail of the wear indicator 18 in accordance with the present invention.

As can be seen in these Figures, the rib 20 presents an axial thickness EN that is less than the axial thickness EV of the web so as to form a step M between a flat 20*a* of the rib 20 and a surface S of the web 14 from which the blades 16 extend. In other words, this step M constitutes a step down in the flow direction F of air through the compressor wheel 10. Thus, the rib 20 is located at an axial end of the peripheral edge remote from the surface S from which the blades 16 project.

Furthermore, the rib 20 presents a radial extent HN that preferably lies in the range 0.5 mm to 3 mm so as to leave radial clearance between the end of the rib 20 and the diffuser 11 of the compression stage 13.

This step 20 presents an axial extent HM preferably lying in the range 0.5 mm to 1.5 mm, for a purpose that is explained below.

Figure 4:
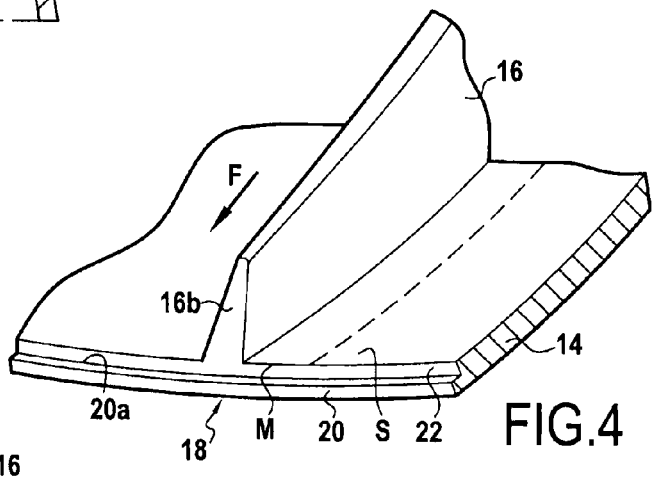
FIG. 4 is a fragmentary view of the trailing edge of a blade of the FIG. 1 wheel when said wheel is not eroded.
Figure 5:
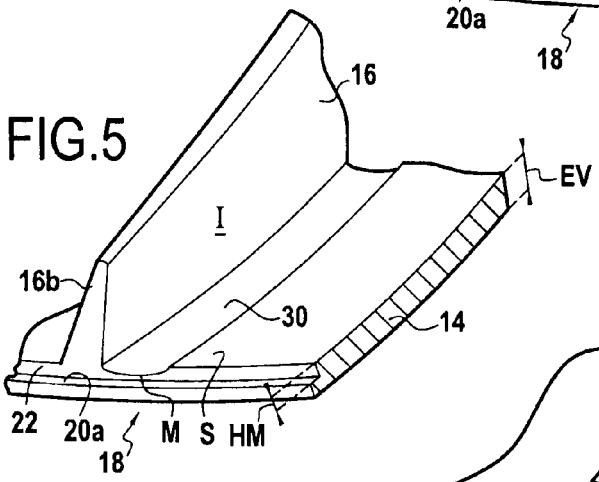
FIG. 5 is a fragmentary view of the trailing edge of the blade of the FIG. 1 wheel when said wheel is slightly eroded, the erosion indicator being partially consumed.
Figure 6:
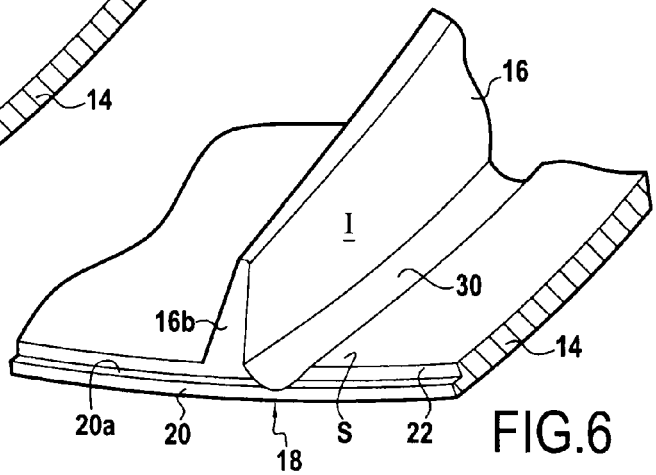
FIG. 6 is a fragmentary view of the trailing edge of a blade of the FIG. 1 wheel when said wheel is severely eroded, the erosion indicator being totally consumed.

With reference to FIGS. 4 to 6, there follows an explanation of how the erosion indicator operates.

These figures show the pressure side of one of the blades 16, close to its trailing edge 16*b*.

When the wheel is not eroded, e.g. as applies with a new wheel, the web 14 does not present any erosion profile at the root of the blade, as can be seen in FIG. 4.

After several hundreds of hours of operation, the particles conveyed by the flow of air give rise to erosion that is represented by the appearance of a furrow 30 at the root of the blade beside its pressure face I, as can be seen in FIG. 5.

The depth of this furrow 30 increases progressively and tends to consume the axial thickness EV of the web 14.

In FIG. 5, it can be seen that the furrow 30 at the trailing edge 16*b* presents a depth that is less than the axial extent HM of the step M. In other words, in this condition, the step M has not been completely eroded and the rib 20 has not been attacked.

Preferably, it is considered that the wear of the compressor wheel 10 is still acceptable so long as erosion has not attacked the rib 20.

In a more advanced state of erosion, such as that shown in FIG. 6, it can be seen that the furrow 30 has attacked the rib 20 such that the step M has disappeared (at the root of the blade 16 on its pressure side I).

In other words, the depth of the furrow 30 is greater than the axial extent HM of the step M. In this step, the erosion indicator 18 is completely eroded, which means that the compressor wheel 10 needs to be changed.

Figure 7:
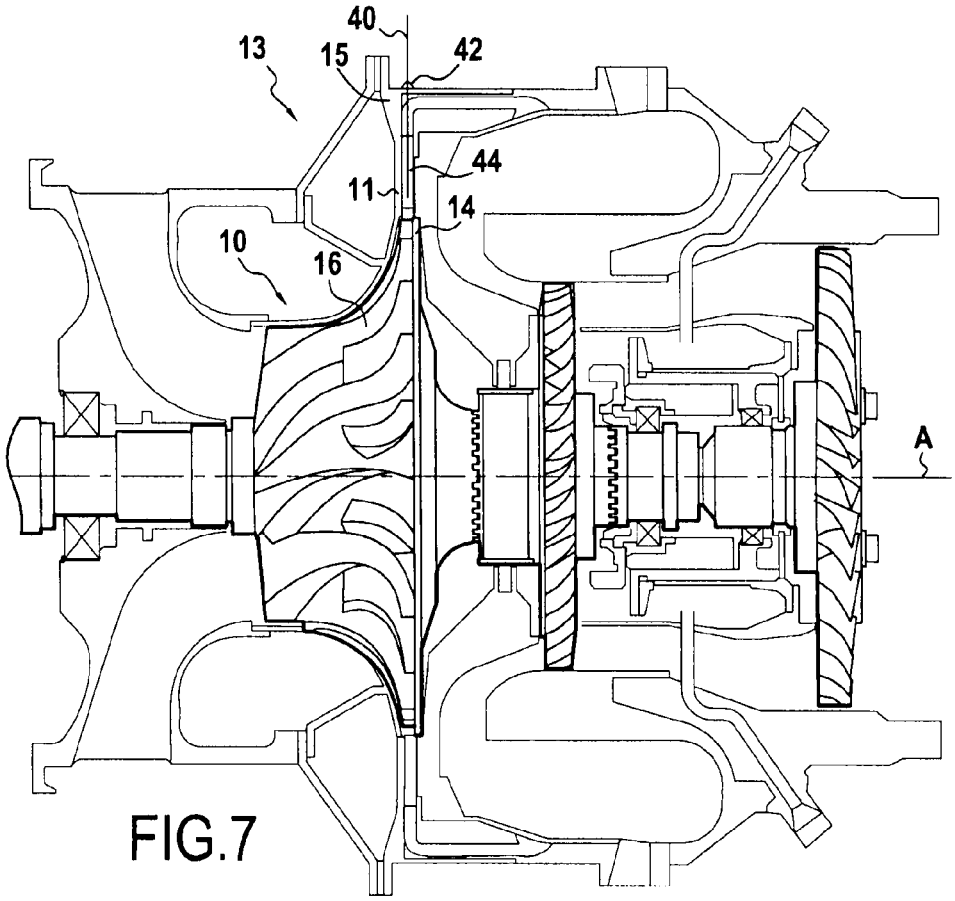
FIG. 7 is a section view of a helicopter gas turbine including the compressor wheel of FIG. 1.

In accordance with the present invention, wear of the erosion indicator 18 is advantageously inspected using a camera, preferably an endoscope 40, that is inserted through an inlet 42 in the casing 15 of the compression stage 13, specifically via a bulge as shown diagrammatically in FIG. 7.

The endoscope 40 is inserted through a radial diffuser 44 that is usually to be found in compression stages.

As can be understood with the help of FIG. 2, the endoscope 40 serves to observe and inspect the state of wear of the erosion indicator 18 without it being necessary to completely disassemble the wheel 10.

In practice, the inventors have found that the beginning of erosion of the rib 20, as represented by total wear of the erosion indicator 18, can easily be detected with the help of the endoscope. The disappearance of the step M associated with erosion of the rib is seen easily.

To summarize, during endoscopic inspection of the erosion indicator 18, two situations may arise: either the step M is still present and the rib 20 does not present any trace of erosion, such that the compressor wheel 10 may continue to be used; or else the step M has disappeared and the rib 20 presents traces of erosion, in which case the wheel needs to be changed.

The invention claimed is:

1. A centrifugal compressor wheel comprising:

a hub;

a web extending radially from the hub; and a plurality of blades carried by the wheel;

wherein the web includes an erosion indicator of the wheel, wherein the erosion indicator comprises at least one rib projecting radially from a peripheral edge of the web at a location of a trailing edge of one of the blades, wherein the rib presents an axial thickness that is less than an axial thickness of the web so as to form a step between a flat of the rib and a surface of the web from which the blades extend, and wherein the rib presents a radial extent, the step being provided on an upstream face of the radial extent, and an outer radial face of the radial extent directly facing a diffuser of a compression stage so as to present a radial space therebetween.

2. A centrifugal compressor wheel according to claim 1, wherein the step presents an axial extent lying in a range 0.5 mm to 1.5 mm.

3. A centrifugal compressor wheel according to claim 1, wherein the radial extent of the rib lies in a range 0.5 mm to 3 mm.

4. A centrifugal compressor wheel according to claim 1, wherein the rib extends along a circumference of the web.

5. A turbomachine compression stage comprising:

a compressor wheel according to claim 1; and a casing including an inlet to enable an endoscope to be inserted into the compression stage so as to inspect the wear of the erosion indicator.

6. A turbomachine comprising a compression stage according to claim 5.

7. A method of determining erosion of a centrifugal compressor wheel of a compression stage comprising:

providing a compressor wheel including a hub;

a web extending radially from the hub; and a plurality of blades carried by the wheel;

providing an erosion indicator of the wheel in the web, the erosion indicator including at least one rib projecting radially from a peripheral edge of the web at a location of a trailing edge of one of the blades, the rib presenting an axial thickness that is less than an axial thickness of the web so as to form a step between a flat of the rib and a surface of the web from which the blades extend; and inserting an endoscope into the compression stage to inspect wear of the erosion indicator of the wheel; and determining acceptability of the compressor wheel based on the inspected wear of the erosion indicator of the wheel, wherein the compressor wheel is acceptable if a depth of a furrow at the trailing edge is less than the axial extent of the step.

8. A method according to claim 7, wherein the endoscope is inserted into the compression stage via an inlet of a casing.

9. A method according to claim 7, further comprising replacing the compressor wheel when the depth of the furrow is greater than the axial extent of the step.

* * * * *